US010526688B2

(12) United States Patent
Nagao et al.

(10) Patent No.: US 10,526,688 B2
(45) Date of Patent: Jan. 7, 2020

(54) NICKEL-BASED INTERMETALLIC ALLOY AND METHOD FOR PRODUCING THE SAME

(71) Applicants: HONDA MOTOR CO., LTD., Minato-ku, Tokyo (JP); OSAKA PREFECTURE UNIVERSITY PUBLIC CORPORATION, Sakai-shi, Osaka (JP)

(72) Inventors: Kazuki Nagao, Wako (JP); Yusuke Kikuchi, Wako (JP); Masahiro Hayashi, Wako (JP); Takayuki Takasugi, Izumi (JP); Yasuyuki Kaneno, Sakai (JP)

(73) Assignees: HONDA MOTOR CO., LTD., Tokyo (JP); OSAKA PREFECTURE UNIVERSITY PUBLIC CORPORATION, Osaka (JP)

( * ) Notice: Subject to any disclaimer, the term of this patent is extended or adjusted under 35 U.S.C. 154(b) by 0 days.

(21) Appl. No.: 15/901,941

(22) Filed: Feb. 22, 2018

(65) Prior Publication Data

US 2018/0245191 A1 Aug. 30, 2018

(30) Foreign Application Priority Data

Feb. 27, 2017 (JP) ..... 2017-034735

(51) Int. Cl.

| | |
|---|---|
| ***C22F 1/10*** | (2006.01) |
| ***C22C 1/02*** | (2006.01) |
| ***C22C 19/03*** | (2006.01) |

(52) U.S. Cl.
CPC ..... *C22F 1/10* (2013.01); *C22C 1/023* (2013.01); *C22C 19/03* (2013.01)

(58) Field of Classification Search
CPC ..... C22F 1/10; C22C 1/023; C22C 19/03
See application file for complete search history.

(56) References Cited

U.S. PATENT DOCUMENTS

| | | | | |
|---|---|---|---|---|
| 6,033,498 | A * | 3/2000 | Chen | C22C 19/057 148/555 |
| 8,197,618 | B2 * | 6/2012 | Takasugi | C22F 1/10 148/429 |
| 8,696,833 | B2 * | 4/2014 | Takasugi | C22C 19/03 148/429 |
| 2008/0175745 | A1 | 7/2008 | Takasugi et al. | |
| 2009/0120543 | A1 | 5/2009 | Takasugi et al. | |

FOREIGN PATENT DOCUMENTS

| | | |
|---|---|---|
| JP | 2006-299403 | 11/2006 |
| JP | 2016-160495 | 9/2016 |
| WO | 2007/086185 | 8/2007 |

* cited by examiner

*Primary Examiner* — Jessee R Roe
(74) *Attorney, Agent, or Firm* — Amin, Turocy & Watson, LLP

(57) ABSTRACT

There is provided a Ni-based intermetallic alloy having a dual multi-phase microstructure containing a primary precipitate $L1_2$ phase and an ($L1_2$+$D0_{22}$) eutectoid microstructure. Thus, the Ni-based intermetallic alloy contains Ni, Al, and V as basic elements, and the contents of Ni, Al, and V are controlled to form the dual multi-phase microstructure. The Ni-based intermetallic alloy further contains at least one of Zr and Hf in addition to the basic elements.

15 Claims, 9 Drawing Sheets

FIG. 4

| No. | | Composition ratio (at%) | | | | | | | | | | | | Crack initiation strain (%) | 0.2% proof stress (MPa) |
|---|---|---|---|---|---|---|---|---|---|---|---|---|---|---|---|
| | | Ni | Al | V | Zr | Hf | Nb | Mo | C | Ti | Co | Cr | B | | |
| Example | 1 | Balance | 9.0 | 9.5 | 0.5 | 0 | 0 | 2.5 | 0 | 1.5 | 4.0 | 4.0 | 0.026 | 45.0 | 813 |
| | 2 | Balance | 9.0 | 9.5 | 0 | 0.5 | 0 | 2.5 | 0 | 1.5 | 4.0 | 4.0 | 0.026 | 30.0 | 741 |
| | 3 | Balance | 9.0 | 9.5 | 0.5 | 0 | 0 | 2.5 | 0.46 | 1.5 | 4.0 | 4.0 | 0.026 | 45.0 | 883 |
| | 4 | Balance | 9.0 | 9.5 | 0 | 0.47 | 0 | 2.5 | 0.47 | 1.5 | 4.0 | 4.0 | 0.026 | 46.0 | 874 |
| | 5 | Balance | 9.0 | 9.5 | 1.0 | 0 | 2.0 | 0 | 0.46 | 1.5 | 4.0 | 4.0 | 0.026 | 35.0 | 895 |
| | 6 | Balance | 9.0 | 9.5 | 0 | 1.0 | 2.0 | 0 | 0.47 | 1.5 | 4.0 | 4.0 | 0.026 | 34.3 | 865 |
| | 7 | Balance | 9.0 | 9.5 | 0.5 | 0 | 1.0 | 1.5 | 0.46 | 1.5 | 4.0 | 4.0 | 0.026 | 42.5 | 886 |
| | 8 | Balance | 9.0 | 9.5 | 0 | 0.5 | 1.0 | 1.5 | 0.47 | 1.5 | 4.0 | 4.0 | 0.026 | 29.7 | 882 |
| | 9 | Balance | 9.0 | 9.5 | 1.0 | 0 | 0 | 2.0 | 0.46 | 1.5 | 4.0 | 4.0 | 0.026 | 38.9 | 883 |
| | 10 | Balance | 9.0 | 9.5 | 0 | 1.0 | 0 | 2.0 | 0.47 | 1.5 | 4.0 | 4.0 | 0.026 | 37.4 | 836 |
| | 11 | Balance | 9.0 | 9.5 | 1.5 | 0 | 0 | 0 | 1.5 | 1.5 | 4.0 | 4.0 | 0.026 | 41.3 | 707 |
| | 12 | Balance | 9.0 | 9.5 | 0 | 1.5 | 0 | 0 | 1.5 | 1.5 | 4.0 | 4.0 | 0.026 | 39.0 | 673 |
| | 13 | Balance | 9.0 | 9.5 | 0.25 | 0 | 0 | 2.5 | 0.25 | 1.5 | 4.0 | 4.0 | 0.026 | 37.8 | 805 |
| | 14 | Balance | 9.0 | 9.5 | 1.0 | 0 | 0 | 1.0 | 1.0 | 1.5 | 4.0 | 4.0 | 0.025 | 46.0 | 778 |
| | 15 | Balance | 9.0 | 9.5 | 0 | 0.67 | 0 | 2.0 | 0.33 | 1.5 | 4.0 | 4.0 | 0.026 | 37.7 | 809 |
| | 16 | Balance | 9.0 | 9.5 | 0 | 1.0 | 0 | 1.0 | 1.0 | 1.5 | 4.0 | 4.0 | 0.026 | 32.3 | 728 |
| | 17 | Balance | 9.0 | 9.5 | 0.5 | 0.5 | 0 | 2.0 | 0.47 | 1.5 | 4.0 | 4.0 | 0.026 | 42.6 | 854 |
| | 18 | Balance | 9.0 | 9.4 | 0.2 | 0.6 | 0 | 2.2 | 0.47 | 1.5 | 4.0 | 4.0 | 0.026 | 34.7 | 851 |
| | 19 | Balance | 8.9 | 9.4 | 0.49 | 0 | 0 | 2.5 | 1.37 | 1.5 | 3.9 | 3.9 | 0.025 | 48.0 | 834 |
| | 20 | Balance | 8.9 | 9.4 | 0 | 0.46 | 0 | 2.5 | 1.38 | 1.5 | 3.9 | 3.9 | 0.026 | 40.0 | 837 |
| Comparative Example | | | 9.0 | 9.5 | 0 | 0 | 3.0 | 0 | 0.09 | 1.5 | 4.0 | 4.0 | 0.026 | 18.0 | 997 |

NICKEL-BASED INTERMETALLIC ALLOY AND METHOD FOR PRODUCING THE SAME

CROSS-REFERENCE TO RELATED APPLICATION

This application is based upon and claims the benefit of priority from Japanese Patent Application No. 2017-034735 filed on Feb. 27, 2017, the contents of which are incorporated herein by reference.

BACKGROUND OF THE INVENTION

Field of the Invention

The present invention relates to a Ni-based intermetallic alloy that contains, as basic elements, Ni, Al, and V that are in a range of a composition ratio that enables the formation of a dual multi-phase microstructure containing a primary precipitate $Ni_3Al$ phase (hereinafter referred to as the primary precipitate $L1_2$ phase) and an ($Ni_3Al$+$Ni_3V$) eutectoid microstructure (hereinafter referred to as the ($L1_2$+$D0_{22}$) eutectoid microstructure). The present invention further relates to a method for producing the Ni-based intermetallic alloy.

Description of the Related Art

For example, a turbine or the like for a drive unit in an aircraft must be made from high-temperature structural materials that have a light weight, an excellent oxidation resistance, and sufficient strength and hardness (abrasion resistance) even in a high-temperature environment with a temperature of higher than 800° C. As a high-temperature structural material having such properties, a Ni-based intermetallic alloy having a dual multi-phase microstructure containing a primary precipitate $L1_2$ phase and an ($L1_2$+$D0_{22}$) eutectoid microstructure has been proposed in Japanese Laid-Open Patent Publication No. 2006-299403.

Furthermore, Ni-based intermetallic alloys containing Nb and Mo is described respectively in International Publication No. WO 2007/086185 and Japanese Laid-Open Patent Publication No. 2016-160495. As reported in International Publication No. WO 2007/086185 and Japanese Laid-Open Patent Publication No. 2016-160495, strength of the alloy in a high-temperature environment is improved by the addition of Nb, and hardness and tensile strength is improved by the addition of Mo.

SUMMARY OF THE INVENTION

As described in International Publication No. WO 2007/086185 and Japanese Laid-Open Patent Publication No. 2016-160495, it is possible to improve the strength of the Ni-based intermetallic alloy having the dual multi-phase microstructure. However, there is a demand for further improving the other properties.

A principal object of the present invention is to provide a Ni-based intermetallic alloy having a particularly excellent ductility.

Another object of the present invention is to provide a method for producing the Ni-based intermetallic alloy.

According to an aspect of the present invention, there is provided a Ni-based intermetallic alloy having a dual multi-phase microstructure containing a primary precipitate $L1_2$ phase and an ($L1_2$+$D0_{22}$) eutectoid microstructure. The Ni-based intermetallic alloy comprises Ni, Al, and V as basic elements, a composition of Ni, Al, and V being in a range that enables formation of the dual multi-phase microstructure, and further comprises at least one of Zr and Hf, a total composition ratio of the basic elements plus the at least one of Zr and Hf is 100 at %.

According to another aspect of the present invention, there is provided a method for producing a Ni-based intermetallic alloy having a dual multi-phase microstructure containing a primary precipitate $L1_2$ phase and an ($L1_2$+$D0_{22}$) eutectoid microstructure. The method comprises the steps of: mixing at least one of Zr and Hf with basic elements of Ni, Al, and V to prepare an alloy, a composition ratio of Ni, Al, and V being in a range that enables formation of the dual multi-phase microstructure wherein a total composition ratio of the basic elements plus at least one of Zr and Hf is 100 at %; subjecting the alloy to a first heat treatment, thereby forming a single-phase microstructure of an A1 phase (a face-centered cubic Ni solid solution phase); and subjecting the alloy to a second heat treatment, thereby forming a multi-phase microstructure containing the primary precipitate $L1_2$ phase and the A1 phase, and then decomposing the A1 phase to the ($L1_2$+$D0_{22}$) eutectoid microstructure to obtain the dual multi-phase microstructure.

Incidentally, in the present invention, the term "at %" means atomic percent.

The Ni-based intermetallic alloy has the dual multi-phase microstructure containing the primary precipitate $L1_2$ phase and the ($L1_2$+$D0_{22}$) eutectoid microstructure. In other words, the Ni-based intermetallic alloy contains the basic elements of Ni, Al, and V, a composition ratio of Ni, Al, and V being in a range that enables formation of the dual multi-phase microstructure. For example, the composition ratio is such that Al is 5.0 to 13.0 at %, V is 10.0 to 18.0 at %, and Ni is 60.0 at % or more (balance).

In the present invention, at least one of Zr and Hf is added to the basic elements. Zr and Hf are capable of forming a compound particularly together with Ni. The compound is crystallized in a grain boundary. All or part of the grain boundaries in the dual multi-phase microstructure are replaced by an interface made up from the crystallized compound and the dual multi-phase microstructure, whereby intergranular cracking is prevented. As a result, the Ni-based intermetallic alloy has an excellent ductility.

Meanwhile, a certain amount of Zr and Hf are solid-dissolved in the dual multi-phase microstructure. As a result, the Ni-based intermetallic alloy has an excellent strength.

It is preferred that the total content of Zr and Hf is 1.5 at % or less. Thus, in the case of using only one of Zr and Hf and the case of using both of Zr and Hf, the maximum composition ratio is preferably 1.5 at %. When the composition ratio is more than 1.5 at %, it is possible that a coarse compound is generated, and the intergranular cracking cannot be prevented easily.

It is preferred that the Ni-based intermetallic alloy further contains at least one of Nb and Mo. In this case, the Ni-based intermetallic alloy can have a more excellent strength.

It is preferred that the total content of Nb and Mo is 2.5 at % or less.

It is preferred that the Ni-based intermetallic alloy further contains 1.5 at % or less of C. C together with Zr or Hf forms zirconium carbide or hafnium carbide. The carbide is also crystallized in a grain boundary, and acts to prevent the intergranular cracking. As a result, the Ni-based intermetallic alloy has a further improved toughness. When the content of C is more than 1.5 at %, it is possible that coarse carbide is generated, and the intergranular cracking cannot be prevented easily.

It is preferred that the Ni-based intermetallic alloy further contains B. B acts to prevent the intergranular cracking particularly at around room temperature, and thus to improve the ductility. It is preferred that the content of B is 0.02 to 0.1 at %. When the content of B is more than 0.1 at %, it is possible that a low-melting-point phase is formed, whereby the strength or the like of the Ni-based intermetallic alloy is often lowered at a high temperature.

As the second heat treatment, the alloy obtained from the first heat treatment may be subjected to natural cooling or continuous cooling at a predetermined cooling rate. Similarly, as the first heat treatment, the alloy obtained from the mixing step may be subjected to natural cooling or continuous cooling at a predetermined cooling rate.

In the present invention, the dual multi-phase microstructure containing the primary precipitate $L1_2$ phase and the ($L1_2$+$D0_{22}$) eutectoid microstructure is formed by the basic elements of Ni, Al, and V, and the dual multi-phase microstructure further contains at least one of Zr and Hf. At least one of Zr and Hf mainly together with Ni forms the compound in the grain boundary, whereby the intergranular cracking is prevented. Therefore, the resultant Ni-based intermetallic alloy has the excellent ductility. In addition, the resultant Ni-based intermetallic alloy has the excellent strength due to the above-described solid-dissolving.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 4 is a table showing crack initiation strains and strengths of alloys (test samples) according to Examples 1 to 20 and Comparative Example.

DESCRIPTION OF THE PREFERRED EMBODIMENTS

A preferred embodiment of the Ni-based intermetallic alloy and the production method thereof of the present invention will be described in detail below with reference to the accompanying drawings.

Figure 1:
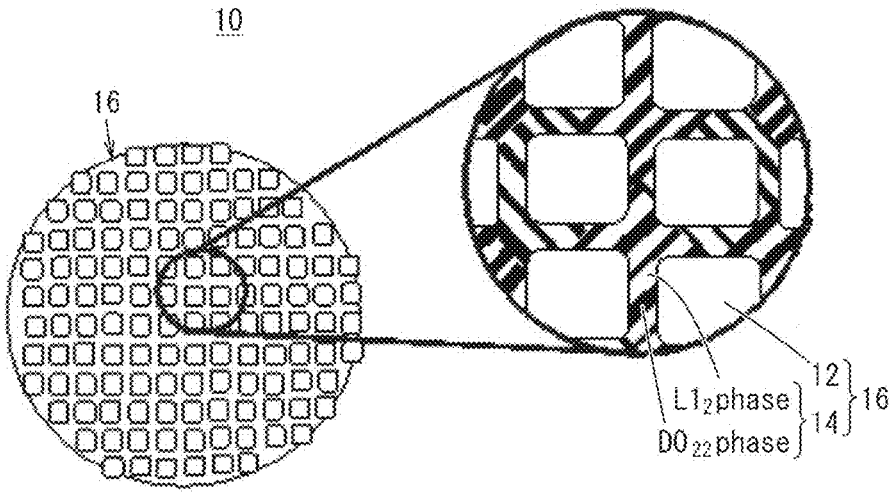
FIG. 1 is a schematic view of a dual multi-phase microstructure in a Ni-based intermetallic alloy according to an embodiment of the present invention.

A dual multi-phase microstructure 16 of a Ni-based intermetallic alloy 10 will be described with reference to FIG. 1. In FIG. 1, a portion of the dual multi-phase microstructure 16 is enlarged and schematically shown.

The Ni-based intermetallic alloy 10 has the dual multi-phase microstructure 16 containing a primary precipitate $L1_2$ phase 12 and an ($L1_2$+$D0_{22}$) eutectoid microstructure 14. The $L1_2$ phase composes $Ni_3Al$, and the $D0_{22}$ phase composes $Ni_3V$. Thus, the Ni-based intermetallic alloy 10 has the dual multi-phase microstructure 16 containing two kinds of intermetallic compound having the close-packing structure. Consequently, as compared with intermetallic compounds having single-phase structures, the Ni-based intermetallic alloy 10 has more excellent ductility and toughness and exhibits more excellent strength and hardness even in a high-temperature environment.

The primary precipitate $L1_2$ phase 12 has an approximately cubic shape. The ($L1_2$+$D0_{22}$) eutectoid microstructure 14 is formed in a channel, i.e. a gap between the approximately cubic shapes of the primary precipitate $L1_2$ phase 12. Thus, in other words, the dual multi-phase microstructure 16 has an upper multi-phase microstructure containing the primary precipitate $L1_2$ phase 12 and the channel, and further has a lower multi-phase microstructure containing the $L1_2$+$D0_{22}$) eutectoid microstructure 14.

The Ni-based intermetallic alloy 10 contains Ni, Al, and V as basic elements, the composition ratio of Ni, Al, and V being in a range that enables the formation of the dual multi-phase microstructure 16. For example, the range of the composition ratio that enables the formation of the dual multi-phase microstructure 16 is that the content of Al is 5.0 to 13.0 at %, the content of V is 10.0 to 18.0 at %, and the content of Ni is 60.0 at % or more where each composition ratio has been defined with the total of all elements being 100 at % in the Ni-based intermetallic alloy 10.

The Ni-based intermetallic alloy 10 further contains at least one of Zr and Hf. Thus, the Ni-based intermetallic alloy 10 is an at least quaternary-system alloy.

The Ni-based intermetallic alloy 10 preferably contains C. It is more preferable for the Ni-based intermetallic alloy 10 to contain at least one of Nb and Mo. The Ni-based intermetallic alloy 10 may further contains B and/or another metal element such as Co.

Figure 2:
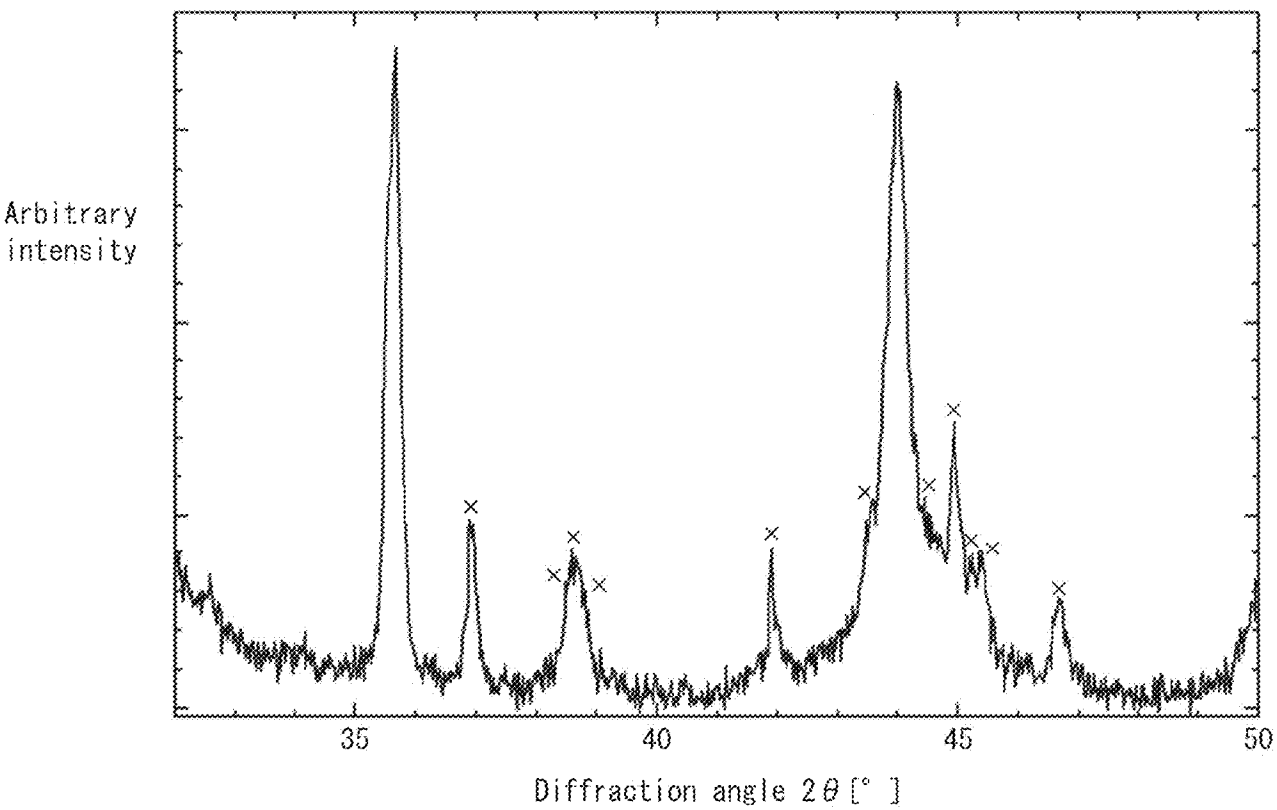
FIG. 2 is an X-ray diffraction profile of a Ni-based intermetallic alloy doped with Zr in a lower-angle region.

FIG. 2 is an X-ray diffraction profile of the Ni-based intermetallic alloy 10 doped with Zr. Within a region where a diffraction angle (2θ) is 37° to 47°, peaks marked with "x" approximately correspond to $Ni_7Zr_2$. In a quantitative SEM-EPMA analysis, a particle of a second phase is observed in a grain boundary and the composition of the particle is found out to be that of $Ni_7Zr_2$.

Thus, in such composition, Zr or Hf forms a compound mainly with Ni. Furthermore, in the case of using C, C reacts with Zr or Hf to generate zirconium carbide or hafnium carbide. In some cases, Zr, Hf, and C may form complex carbide together. The compound or the carbide is a second phase particle in a grain boundary, and the diameter of the particle is generally 1 to 100 μm, typically 10 to 50 μm.

The second phase particle in the grain boundary acts to prevent so-called intergranular cracking. Therefore, the Ni-based intermetallic alloy 10 has an excellent ductility. In addition, Zr and Hf that do not participate in the formation of the carbide or the second phase particle in the grain boundary are solid-dissolved into the dual multi-phase microstructure 16. Therefore, the Ni-based intermetallic alloy 10 has also an excellent strength due to the solid solution strengthening.

It is preferred that the total content of Zr or Hf is 1.5 at % or less with respect to the total content.

As described above, C together with Zr or Hf forms the crystallized compound in the grain boundary and acts to prevent the intergranular cracking. In addition, a part of C solid-dissolves in the dual multi-phase microstructure 16. Thus, as well as Zr and Hf, C acts to improve the toughness and the strength of the Ni-based intermetallic alloy 10.

In a case where the Ni-based intermetallic alloy 10 contains Nb, the Ni-based intermetallic alloy 10 exhibits an improved strength at any temperature in a range from room temperature to high temperature. In a case where the Ni-based intermetallic alloy 10 contains Mo, the Ni-based intermetallic alloy 10 exhibits improved hardness and tensile strength. It is preferred that the total content of Nb or Mo is 2.5 at % or less with respect to the total content (100 at %) of all elements in the Ni-based intermetallic alloy 10. When C is present, Nb and Mo form carbide.

B acts to prevent the intergranular cracking particularly at around room temperature, and thus to improve the ductility. It is preferred that the content of B is 0.02 to 0.1 at % with respect to the total content (100 at %) of all elements in the Ni-based intermetallic alloy 10.

Figure 3:
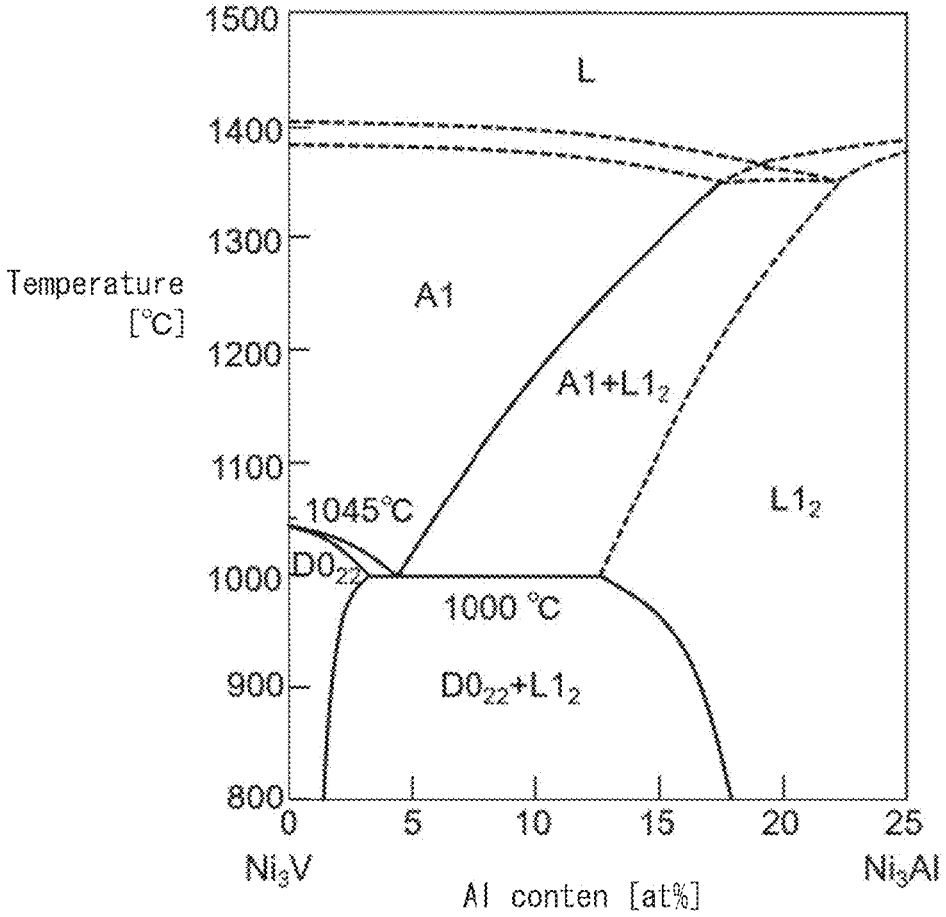
FIG. 3 is a pseudo binary system diagram of $Ni_3V$—$Ni_3Al$.

The Ni-based intermetallic alloy 10 may be produced by a melt casting method, a powder metallurgy method, etc. FIG. 3 is a pseudo binary system diagram of $Ni_3V$—$Ni_3Al$ containing the basic elements of the Ni-based intermetallic alloy 10. A method for producing the Ni-based intermetallic alloy 10 will be described with reference to FIG. 3. In FIG. 3, the horizontal axis represents Al content (at %) and the vertical axis represents temperature (° C.).

First, for example, raw metals of the basic elements (Ni, Al, and V) and at least one of Zr and Hf are mixed in a manner such that the composition ratio of the elements falls within the above ranges. The mixture is melted to prepare a molten metal. It is to be understood that Nb, Mo, C, B, and the like may be added to the mixture in this step. In this case, the molten metal is cooled and solidified to prepare an alloy ingot.

For example, in a case where the melting is conducted in a small arc furnace, the molten metal is cooled at a relatively high cooling rate (solidifying rate) until the molten metal becomes the ingot, whereby the microstructures and the constituent elements could be non-uniformly distributed in the ingot. Therefore, the ingot is subjected to a first heat treatment. In the first heat treatment, the ingot is solution-treated (the constituent elements are mixed) and homogenized. Thus obtained alloy has a single-phase microstructure of a face-centered cubic (fcc) A1 phase. In other words, in the first heat treatment, the conditions of the temperature, the holding time, and the like may be such that the mixture and the homogenization proceed to form the single-phase microstructure of the A1 phase. Incidentally, the A1 phase is a Ni solid solution phase that does not have an ordered structure (i.e. has a disordered structure).

Then, the obtained alloy is subjected to a second heat treatment. Thus, the solution-treated and homogenized alloy ingot is cooled to a temperature at which the ingot has both of the primary precipitate $L1_2$ phase 12 and the A1 phase or has all of the primary precipitate $L1_2$ phase 12, the A1 phase, and the $D0_{22}$ phase, and is further cooled to a temperature equal to or lower than the eutectoid temperature. In this step, the primary precipitate $L1_2$ phase 12 is precipitated from the A1 phase, and the A1 phase remaining in the gap (channel) of the primary precipitate $L1_2$ phase 12 is transformed by a eutectoid reaction to the $D0_{22}$ phase and the $L1_2$ phase.

As a result, as shown in FIG. 1, the upper multi-phase microstructure containing the primary precipitate $L1_2$ phase 12 with the channel and the lower multi-phase microstructure containing the ($L1_2$+$D0_{22}$) eutectoid microstructure 14 are formed. Thus, the Ni-based intermetallic alloy 10, which has the dual multi-phase microstructure 16 containing the upper and lower multi-phase microstructure, can be obtained by the second heat treatment.

It is apparent also from FIG. 3 that when the content of Al is 5.0 to 13.0 at % (the content of V is 10.0 to 18.0 at %, and the content of Ni is 60.0 at % or more), the dual multi-phase microstructure 16 can be formed relatively easily by the above first and second heat treatments.

The first and second heat treatments may be carried out successively. In this case, after the first heat treatment, the alloy may be cooled to the eutectoid temperature at a predetermined rate in a heating furnace.

Alternatively, the Ni-based intermetallic alloy 10 may be produced by a casting method such as a vacuum induction melting method.

The upper and lower multi-phase microstructure can be each formed by further cooling the alloy to the temperature equal to or lower than the eutectoid temperature in the second heat treatment. The Ni-based intermetallic alloy 10 having the dual multi-phase microstructure 16 can be obtained in this manner.

In any of the production methods above, the alloy may be maintained in two stages at different temperatures under the second heat treatment. In this case, the holding temperature of the first stage is set to be higher than the eutectoid temperature, and the holding temperature of the second stage is set to be lower than the eutectoid temperature. The upper multi-phase microstructure is formed at the holding temperature of the first stage, and the lower multi-phase microstructure is formed at the holding temperature of the second stage.

In the first and second heat treatments, the solidified alloy may be left to cool naturally or may cool continuously at an arbitrary cooling rate.

EXAMPLES

Metals of Ni, Al, V, Zr, Hf, Nb, Mo, C, Ti, Co, Cr, and B were mixed to obtain each of compositions of Examples 1 to 20 shown in FIG. 4, the total content of all the constituent elements being 100 at %. Then, each metal was melted in a small arc furnace, and was subjected to first and second heat treatments, to obtain a test sample having a predetermined shape with a gauge portion of diameter 8 mm×length 12 mm.

An alloy piece, which did not contain Zr and Hf, contained 3 at % of Nb, and had the same shape as above, was produced as a test sample which is used as Comparative Example.

As the first heat treatment, the alloy was held at 1280° C. for 5 hours under vacuum in the heating furnace. After the first heat treatment, as the second heat treatment, the alloy was continuously cooled at a cooling rate of 10° C./minute.

Figure 5A:
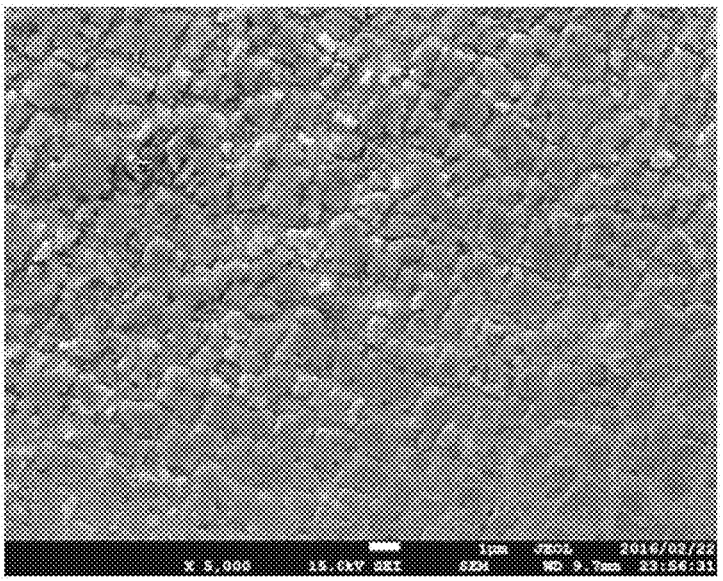
FIGS. 5A and 5B are scanning electron microscope (SEM) photographs of a microstructure according to Example 3.
Figure 5B:
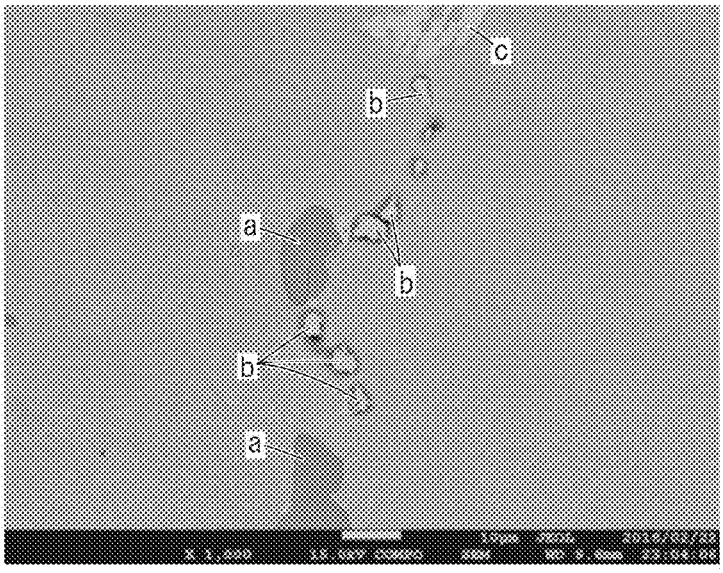
Figure 6A:
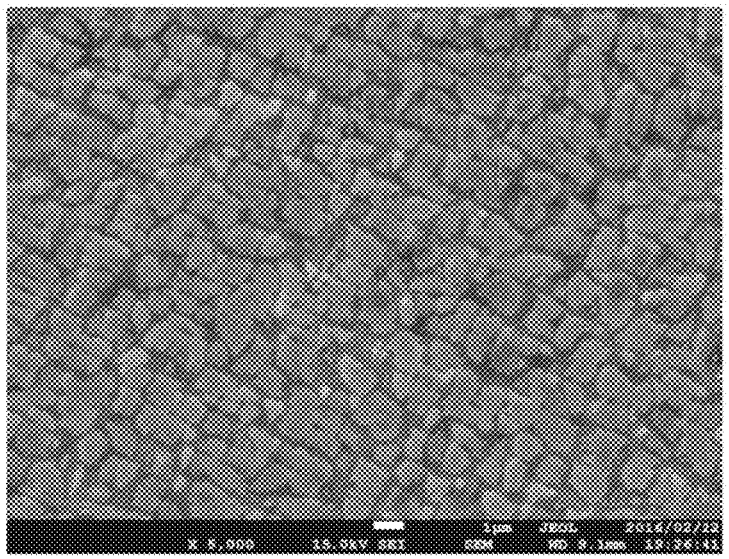
FIGS. 6A and 6B are SEM photographs of a microstructure according to Example 4.
Figure 6B:
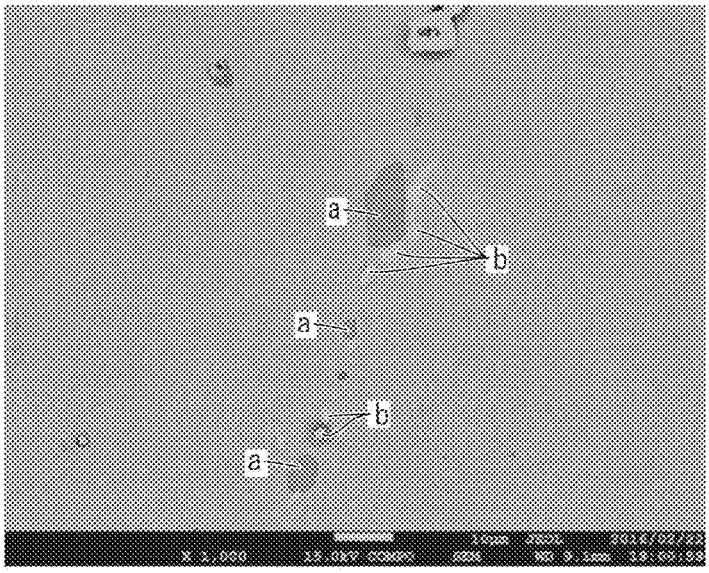

Each of the test samples was observed with an SEM. FIGS. 5A and 5B are SEM photographs of a microstructure of Example 3, and FIGS. 6A and 6B are SEM photographs of a microstructure of Example 4. Backscattered electron images are shown in FIGS. 5B and 6B.

In FIGS. 5A and 6A, a dual multi-phase microstructure containing a cubic primary precipitate $Ni_3Al$ phase and a channel is observed. Thus, it was clear from the SEM photographs that each test sample had the dual multi-phase microstructure 16 containing the primary precipitate $L1_2$ phase 12 and the ($L1_2$+$D0_{22}$) eutectoid microstructure 14. The same results were obtained also in Examples 1, 2, and 5 to 20.

In FIGS. 5B and 6B, a slightly coarse black particle represented by a reference mark "a" and a slightly fine white particle represented by a reference mark "b" were identified. The particles were each composed of carbide. Furthermore, a coarse particle represented by a reference mark "c" in FIG. 5B was identified. The particle was composed of an intermetallic compound. Thus, the coarse particle "c" was considered as a second phase of intermetallic particle.

Then, ductility of the test samples of Examples 1 to 20 and Comparative Example were evaluated. Specifically, each test sample was subjected to a compression test at 800° C. and a strain rate of $8.3\times10^{-5}$ $s^{-1}$, and the crack initiation strain and the 0.2% proof stress were measured. The crack initiation strain means a strain amount measured when the test sample was cracked. A sample having a larger crack initiation strain has a more excellent ductility and is more resistant to fracturing, and thus has a more excellent toughness.

The results are shown in FIG. 4. The samples of Examples 1 to 20 containing at least one of Zr and Hf had higher ductilities than Comparative Example free of Zr and Hf. Thus, the ductility of the Ni-based intermetallic alloy could be improved by doping the basic elements with at least one of Zr and Hf.

It is also clear from FIG. 4 that the 0.2% proof stress of the Ni-based intermetallic alloy could be increased by the addition of Nb or Mo together with C. In other words, the Ni-based intermetallic alloy with further improved ductility (toughness) and strength could be produced by doping the essential elements with C and at least one of Nb and Mo in addition to at least one of Zr and Hf.

In addition, each of the test samples of Examples 5 and 6 was subjected to a tensile test at 800° C. in vacuum at a strain rate of $1.66\times10^{-4}$ $s^{-1}$. Furthermore, each of the test samples of Examples 5 and 6 and Comparative Example was subjected to a tensile test at 800° C. in atmospheric air at a strain rate of $8.3\times10^{-5}$ $s^{-1}$. The elongations of the test samples are shown in the graph of FIG. 7.

Figure 7:
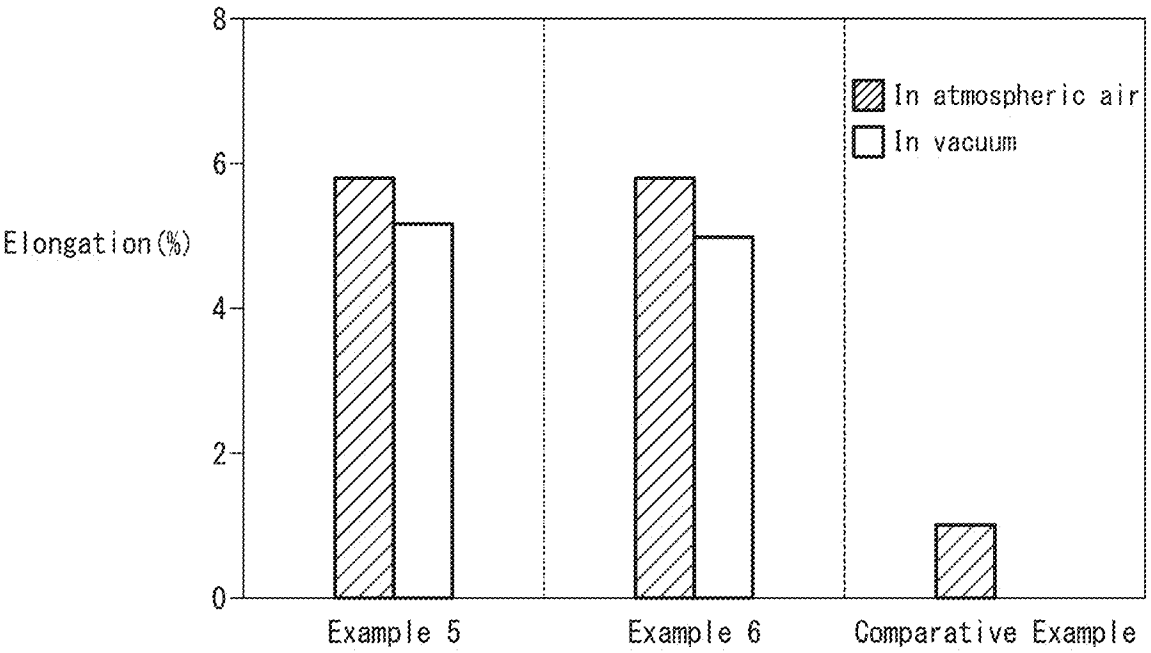
FIG. 7 is a graph showing elongations of test samples according to Examples 5 and 6 and Comparative Example measured in tensile tests.

As is clear from FIG. 7, the test samples of Examples 5 and 6 had significantly larger elongations than that of Comparative Example, and the test samples of Examples 5 and 6 had the excellent elongations even at a high temperature in any atmosphere. Thus, the ductility of the Ni-based intermetallic alloy could be improved by adding at least one of Zr and Hf.

Figure 8A:
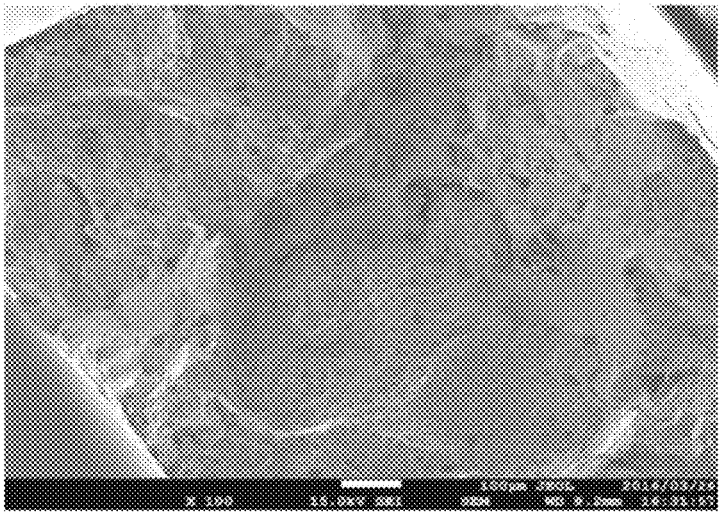
FIGS. 8A and 8B are SEM photographs of a fracture surface of a test sample according to Example 5 taken after a tensile test.
Figure 8B:
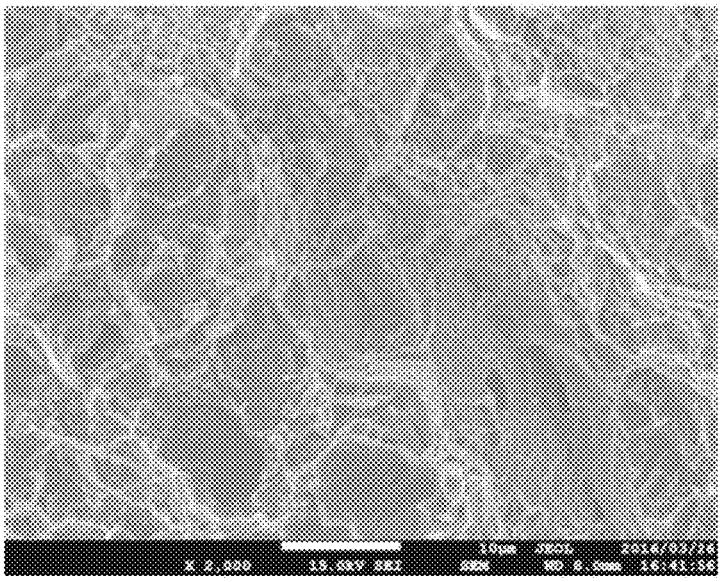
Figure 9A:
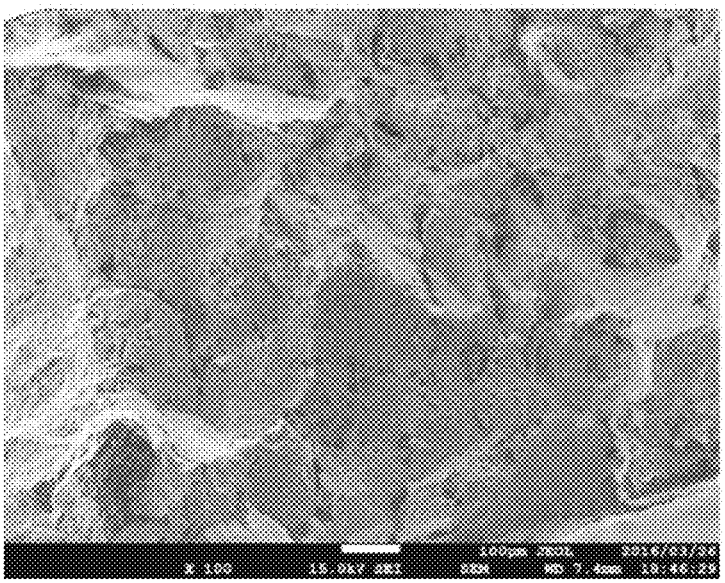
FIGS. 9A and 9B are SEM photographs of a fracture surface of a test sample according to Example 6 taken after a tensile test.
Figure 9B:
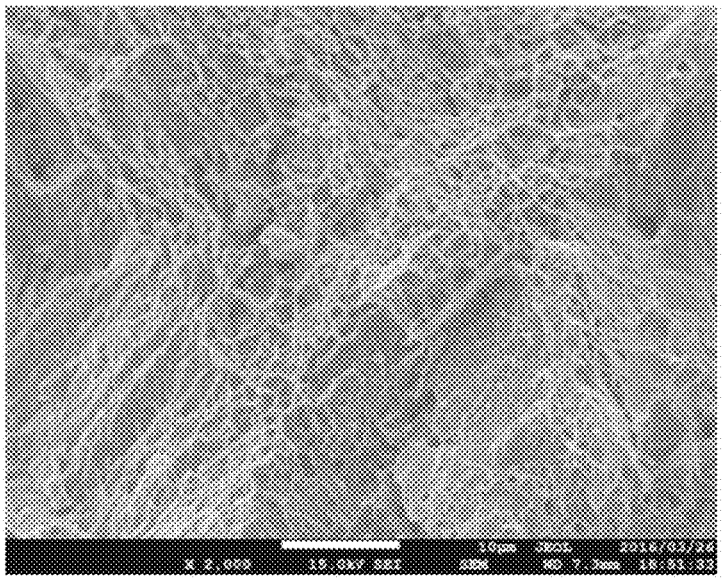

FIGS. 8A and 8B are SEM photographs of a fracture surface of the test sample of Example 5 taken after the tensile test. FIGS. 9A and 9B are SEM photographs of a fracture surface of the test sample of Example 6 taken after the tensile test. The fracture surfaces were dimpled surfaces. Consequently, it was confirmed that a ductile fracture was caused in each of the test samples.

The present invention is not particularly limited to the above embodiment. Various changes and modifications may be made to the embodiment without departing from the scope of the invention.

What is claimed is:

1. A Ni-based intermetallic alloy having a dual multi-phase microstructure containing a primary precipitate $L1_2$ phase and an ($L1_2$+$D0_{22}$) eutectoid microstructure, wherein the Ni-based intermetallic alloy consists of Ni, Al, and V as basic elements and at least one of Zr and Hf, a composition ratio of Ni, Al, and V being in a range that enables formation of the dual multi-phase microstructure, and a total composition ratio of the basic elements plus the at least one of Zr and Hf is 100 at %.

2. The Ni-based intermetallic alloy according to claim 1, comprising 1.5 at % or less of the at least one of Zr and Hf.

3. The Ni-based intermetallic alloy according to claim 1, wherein the Ni and the at least one Zr and Hf form a compound in a grain boundary.

4. The Ni-based intermetallic alloy according to claim 3, wherein the compound is a crystallized compound.

5. A method for producing a Ni-based intermetallic alloy having a dual multi-phase microstructure containing a primary precipitate $L1_2$ phase and an ($L1_2$+$D0_{22}$) eutectoid microstructure, comprising the steps of:

mixing at least one of Zr and Hf with basic elements of Ni, Al, and V to prepare an alloy, a composition ratio of Ni, Al, and V being in a range that enables formation of the dual multi-phase structure wherein the at least one of Zr and Hf is mixed with the basic elements to prepare the alloy in such a manner that a total composition ratio consisting of the basic elements plus the at least one of Zr and Hf is 100 at %;

subjecting the alloy to a first heat treatment, thereby forming a single-phase microstructure of an A1 phase; and subjecting the alloy to a second heat treatment, thereby forming a multi-phase microstructure containing the primary precipitate $L1_2$ phase and the A1 phase, and then decomposing the A1 phase to the ($L1_2$+$D0_{22}$) eutectoid microstructure to obtain the dual multi-phase microstructure.

6. The method according to claim 5, wherein the second heat treatment is a process where the alloy is subjected to natural cooling or continuous cooling at a predetermined cooling rate after the first heat treatment.

7. The method according to claim 5, wherein the at least one of Zr and Hf is mixed with the basic elements to prepare the alloy in such a manner that the Ni-based intermetallic alloy contains 1.5 at % or less of the at least one of Zr and Hf.

8. A Ni-based intermetallic alloy having a dual multi-phase microstructure containing a primary precipitate $L1_2$ phase and an ($L1_2$+$D0_{22}$) eutectoid microstructure, wherein the Ni-based intermetallic alloy comprises Ni, Al and V as basic elements, a composition ratio of Ni, Al, and V being in a range that enables formation of the dual multi-phase microstructure, and further comprises at least one of Zr and Hf and less than or equal to 2.5 at % of at least one of Nb and Mo, and wherein the Ni and the at least one Zr and Hf form a crystallized compound in a grain boundary.

9. The Ni-based intermetallic alloy according to claim 8, comprising 1.5 at % or less of the at least one of Zr and Hf.

10. The Ni-based intermetallic alloy according to claim 8, further comprising less than or equal to 1.5 at % of C.

11. The Ni-based intermetallic alloy according to claim 8, further comprising greater than or equal to 0.02 at % or less than or equal to 0.1 at % of B.

12. A method for producing a Ni-based intermetallic alloy having a dual multi-phase microstructure containing a primary precipitate $L1_2$ phase and an ($L1_2$+$D0_{22}$) eutectoid microstructure, comprising the steps of:

mixing at least one of Zr and Hf with basic elements of Ni, Al and V to prepare an alloy, a composition ratio of Ni, Al and V being in a range that enables formation of the dual multi-phase microstructure, wherein the at least one of Zr and Hf is mixed with the basic elements to prepare the alloy in such a manner that the Ni-based intermetallic alloy contains less than or equal to 2.5 atomic percent of at least one of Nb and Mo; subjecting the alloy to a first heat treatment, thereby forming a single-phase microstructure of an A1 phase; and subjecting the alloy to a second heat treatment, thereby forming a multi-phase microstructure containing the primary precipitate $L1_2$ phase and the A1 phase, and then decomposing the A1 phase to the ($L1_2$+$D0_{22}$) eutectoid microstructure to obtain Ni-based intermetallic alloy having the dual multi-phase microstructure, wherein the Ni and the at least one Zr and Hf form a crystallized compound in a grain boundary.

13. The method according to claim 12, wherein the second heat treatment is a process where the alloy is subjected to natural cooling or continuous cooling at a predetermined cooling rate after the first heat treatment.

14. The method according to claim 12, wherein the at least one of Zr and Hf is mixed with the basic elements to prepare the alloy in such a manner that the Ni-based intermetallic alloy contains 1.5 at % or less of the at least one of Zr and Hf.

15. The method according to claim 12, wherein B is further mixed with the basic elements to prepare the alloy in such a manner that the Ni-based intermetallic alloy contains 0.02 to 0.1 at % of B.

* * * * *